US009312088B2

(12) United States Patent
Sorenson, Sr.

(10) Patent No.: US 9,312,088 B2
(45) Date of Patent: Apr. 12, 2016

(54) SOLENOID ACTUATED CIRCUIT BREAKER

(71) Applicant: Richard Sorenson, Sr., Ft. Lauderdale, FL (US)

(72) Inventor: Richard Sorenson, Sr., Ft. Lauderdale, FL (US)

(73) Assignee: CARLING TECHNOLOGIES, INC., Plainville, CT (US)

( * ) Notice: Subject to any disclaimer, the term of this patent is extended or adjusted under 35 U.S.C. 154(b) by 0 days.

(21) Appl. No.: 14/054,435

(22) Filed: Oct. 15, 2013

(65) Prior Publication Data

US 2015/0101914 A1 Apr. 16, 2015

(51) Int. Cl.

| | |
|---|---|
| ***H01H 21/22*** | (2006.01) |
| ***H01H 21/36*** | (2006.01) |
| ***H01H 89/06*** | (2006.01) |
| ***H01H 71/12*** | (2006.01) |
| *H01H 71/02* | (2006.01) |

(52) U.S. Cl.

CPC ..... *H01H 71/12* (2013.01); *H01H 71/0228* (2013.01)

(58) Field of Classification Search

USPC ..... 439/951, 42–47; 200/400, 43.14

See application file for complete search history.

(56) References Cited

U.S. PATENT DOCUMENTS

| | | | | |
|---|---|---|---|---|
| 4,974,192 | A * | 11/1990 | Face et al. | 710/1 |
| 5,580,268 | A * | 12/1996 | Miyazawa | 439/352 |
| 7,255,570 | B1 * | 8/2007 | Feldman et al. | 439/64 |
| 7,367,812 | B2 * | 5/2008 | Shih et al. | 439/65 |
| 2006/0244557 | A1 * | 11/2006 | Sorenson | 335/172 |

* cited by examiner

*Primary Examiner* — Renee S Luebke
*Assistant Examiner* — Ahmed Saeed
(74) *Attorney, Agent, or Firm* — St. Onge Steward Johnston & Reens, LLC

(57) ABSTRACT

A circuit breaker includes a breaker handle that is remotely operated using a modular actuator mechanism. The actuator mechanism may be a solenoid or other electromechanical actuator that converts an electrical signal to a mechanical force which is applied to the breaker handle. The actuator mechanism is mechanically connected to the circuit breaker in a removable fashion, such as by a tab-and-slot connection, and electrically connected to the circuit breaker in a removable fashion using a plug, edge connector, or other suitable mechanism such that the electrical connection is made when the actuator mechanism is installed, and without the need for additional wiring or other installation steps.

17 Claims, 2 Drawing Sheets

SOLENOID ACTUATED CIRCUIT BREAKER

The invention relates to remotely operated circuit breakers in general, and to a circuit breaker having a breaker handle that is remotely operated using a modular solenoid mechanism.

BACKGROUND OF THE INVENTION

A circuit breaker is a device that can be used to protect an electrical circuit from damage caused by an overload or a short circuit. If a power surge occurs in a circuit protected by the circuit breaker, for example, the breaker will trip. This will cause a breaker that was in the "on" position to flip to the "off" position, and will interrupt the electrical power leading from that breaker. By tripping in this way, a circuit breaker can prevent a fire from starting on an overloaded circuit, and can also prevent the destruction of the device that is drawing the electricity or other devices connected to the protected circuit.

A standard circuit breaker has a line and a load. Generally, the line receives incoming electricity, most often from a power company. This is sometimes referred to as the input into the circuit breaker. The load, sometimes referred to as the output, feeds out of the circuit breaker and connects to the electrical components being fed from the circuit breaker. A circuit breaker may protect an individual component connected directly to the circuit breaker, for example, an air conditioner, or a circuit breaker may protect multiple components, for example, household appliances connected to a power circuit which terminates at electrical outlets.

A circuit breaker can be used as an alternative to a fuse. Unlike a fuse, which operates once and then must be replaced, a circuit breaker can be reset (either manually or automatically) to resume normal operation. When the power to a circuit shuts down, an operator can inspect the electrical panel to see which breaker has tripped to the "off" position. The breaker can then be flipped to the "on" position and power will resume.

In general, a circuit breaker has two contacts located inside of a housing. Typically, the first contact is stationary, and may be connected to either the line or the load. Typically, the second contact is movable with respect to the first contact, such that when the circuit breaker is in the "off," or tripped position, a gap exists between the first and second contact, and the line is disconnected from the load.

In some applications, it is desirable to operate a circuit breaker remotely. For example, an operator may typically trip a circuit breaker manually to de-energize a protected circuit so that it can be inspected or serviced. However in some circuits, operating the breaker can produce a dangerous arc, creating a safety hazard for the operator. In still other circuits, the circuit breaker may be located in a confined or hazardous environment. In these situations, it is beneficial to operate the circuit breaker remotely. In other applications, such as in large office buildings, it may be desirable, for example, to automatically trip circuits powering large banks of overhead lights, such that entire floors or sections of floors can be automatically shut down in response to timed signals at night without requiring that each individual light switch have a timer.

Known approaches to remotely controlling circuit breakers include incorporating a mechanism into the circuit breaker which can intentionally trip the circuit breaker mechanism and/or reset it. Examples of such mechanisms are solenoids or motors used to activate the trip mechanism, and solenoids or motors which are used to reset the circuit breaker by rearming the trip mechanism, such as by physically moving the switch handle using a solenoid or other motor or mechanism that can be remotely operated.

However, the lifespan of a solenoid employed to reset a circuit breaker using the switching handle may be limited. In some cases, the re-arming solenoid may wear out or otherwise fail far before the other components of the circuit breaker. This can require an unacceptably premature replacement of the entire circuit breaker as a unit, increasing costs.

In order to increase the number of cycles that such circuit breaker units can endure before failure, it would be conceivable to increase the robustness of the solenoid. However, this may increase the costs, power consumption, and/or size of the solenoid beyond acceptable limits.

What is desired therefore, is a circuit breaker featuring a replaceable re-arming solenoid which addresses these and other disadvantages.

SUMMARY OF THE INVENTION

Accordingly, it is an object of the present invention to provide a remotely resettable circuit breaker. It is a further object of the present invention to provide a remotely resettable circuit breaker which includes a modular replaceable resetting mechanism.

These and other objectives are achieved by providing a circuit breaker that includes a housing; a circuit breaker mechanism having a tripped state and an untripped state; a switch handle having an off position and an on position and configured to toggle the circuit breaker between the tripped state and the untripped state; and, an actuator removably attached to the housing and disposed to move the switch handle from the off position to the on position.

In some implementations, the actuator is removably attached to the housing using a tab and slot connection.

In some implementations, the actuator is removably electrically connected to the circuit breaker using a plug connector or an edge connector. The actuator may be attached such that attaching the actuator to the housing simultaneously connects the actuator electrically to the circuit breaker. Optionally, the actuator comprises a solenoid or a linear actuator.

In some implementations, the circuit breaker includes a wiring harness having a terminal in communication with the actuator. Optionally, the actuator is remotely operable by supplying a signal to the terminal.

In some implementations, the circuit breaker includes a voltage coil configured to selectively trip the circuit breaker mechanism.

In some implementations, the voltage coil is configured to trip the circuit breaker mechanism when there is a ground fault, when there is earth leakage, or in response to a signal. The voltage coil may be connected to a wiring harness, and may be configured to trip the circuit breaker mechanism in response to a signal received via the wiring harness. Optionally, the voltage coil is configured to remotely trip the circuit breaker mechanism.

In some implementations, the circuit breaker outputs a signal indicative of breaker status. This output may be produced by an auxiliary switch or the like, and may indicate status, such as breaker untripped, breaker tripped due to overcurrent, breaker tripped due to ground fault, etc.

Other objects of the invention and its particular features and advantages will become more apparent from consideration of the following drawings and accompanying detailed description.

DETAILED DESCRIPTION OF THE INVENTION

Figure 1:
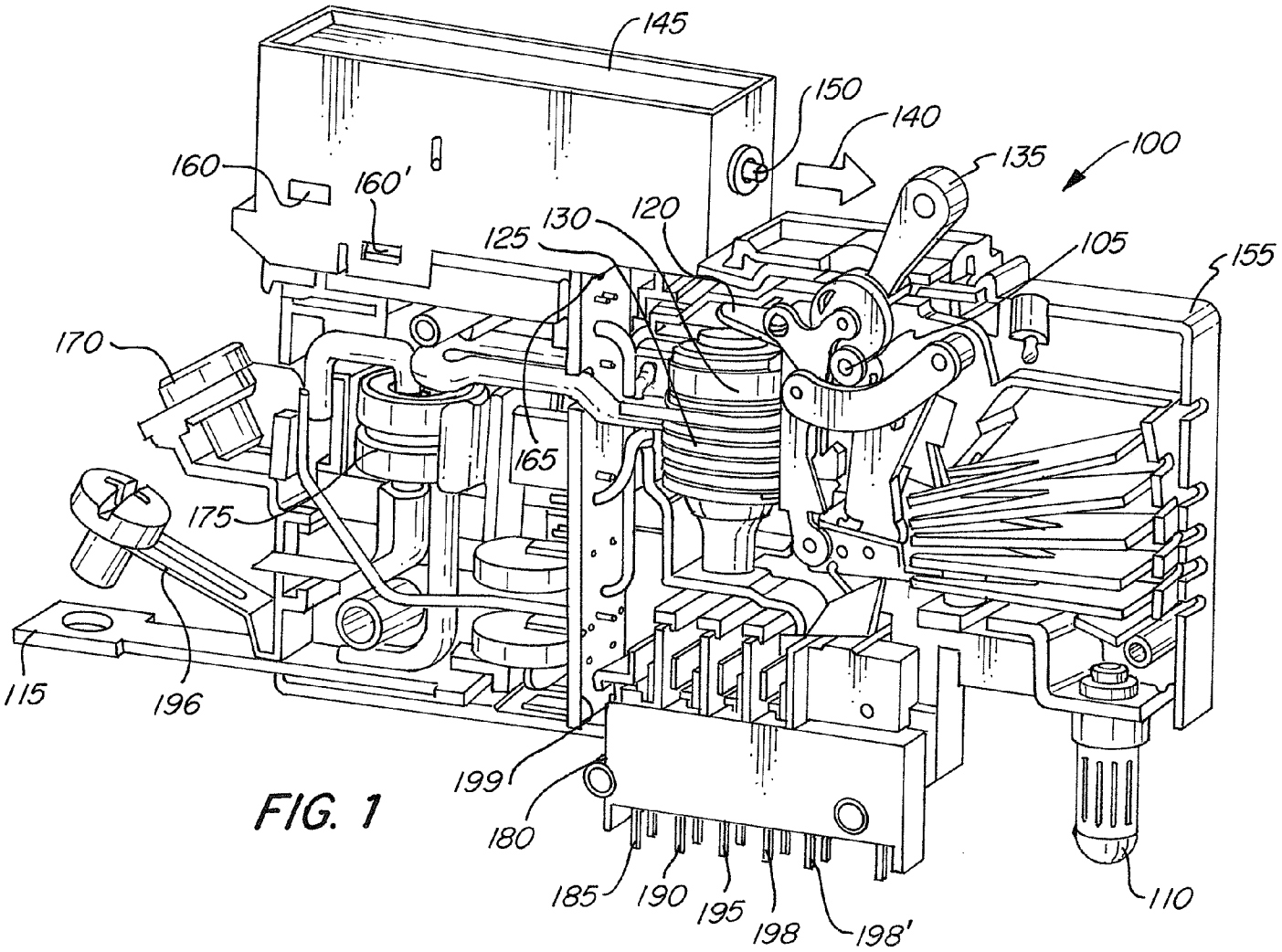
FIG. 1 is a partially cut away perspective view of a circuit breaker illustrating aspects of the invention.

FIG. 1 illustrates a circuit breaker 100 according to aspects of the invention.

Circuit breaker 100 includes a circuit breaker mechanism 105 which controls current flow between a line terminal 110 and a load terminal 115. The line terminal 110 receives electricity from a power source such as a generator (not shown), which in some applications is supplied by a power company. Current may flow between line terminal 110 and load terminal 115 when mechanism 105 is in an untripped state. Current cannot flow between line terminal 110 and load terminal 115 when mechanism 105 is in a tripped state.

Mechanism 105 may be tripped by a tripping mechanism 120. Tripping mechanism 120 may be activated by fault detector 125.

Fault detector 125 is configured to activate the tripping mechanism 120 when a fault condition occurs, such as excess current. In some applications, fault detector 125 is a solenoid which is disposed in series with the line and load terminals. If the current through the solenoid exceeds a certain level, the solenoid generates an electromagnetic field sufficient to activate the tripping mechanism 120. Optionally, such solenoid may also incorporate a plunger or other armature which activates the tripping mechanism when the current exceeds a certain level (not shown).

It is understood that other fault detection methods may also be employed to trip the tripping mechanism upon the occurrence of a specific condition.

Optionally, tripping mechanism 120 may be tripped by voltage coil 130. Voltage coil 130 is configured to allow tripping mechanism 120 to be activated upon the occurrence of a specific condition or upon receiving a remote signal. Tripping mechanism 120 may also be tripped manually by moving switch handle 135 to an "off" position.

Tripping mechanism 120 may be reset (untripped) manually by moving switch handle 135 in the direction indicated by arrow 140, to an "on" position (shown). Switch handle 135 may also be moved to the on position using remote resetting module 145.

Module 145 includes a piston 150 which is configured to extend in the direction of arrow 140 to move switch handle 135 into the on position when module 145 is activated. Those having skill in the art will understand that other types of actuators may be employed without departing from the invention.

Module 145 is removably attached to the housing 155 of breaker 100 using tabs 160, 160', although other ways of removably attaching module 145 to the housing 155 will be evident to those having skill in the art.

Module 145 is removably electrically connected to breaker 100 using a plug connection 165. Connection 165 is preferably configured to electrically connect module 145 to breaker 100 as module 145 is installed. This can have advantages over more traditional configurations involving flying leads or the like of preventing stray wires, increasing the robustness of the connection, and/or improving ease of installation.

Breaker 100 may optionally also include a neutral terminal 170 and a ground fault sensor 175. Ground fault sensor may be configured to activate tripping mechanism 120 using voltage coil 130 when a fault condition is detected.

Breaker 100 may also includes a plug 180 which may be interfaced with a wiring harness (not shown) or another suitable external connection. Plug 180 is configured to communicate electrically with various components of breaker 100, for example, to facilitate signaling to and from an external device or system, such as a power distribution system. Transmission of signals within breaker 100, including from plug 180, may be facilitated by a printed circuit board ("PCB") 199, or other suitable wiring or interconnections.

As shown, plug 180 includes remote resetting terminals 185, 190, which may be used to transmit a reset signal to module 145 to activate piston 150. Plug 180 also includes a voltage coil terminal 195, which may be used to transmit an activation signal to voltage coil 130. Here, voltage coil may be internally grounded, thus only one terminal is required.

Plug 180 may also include additional terminals 198 and 198' which may be used to connect an auxiliary switch 197 to activate one or more of the components of breaker 100 as desired and/or to provide a signal indicative of circuit breaker status to an external device or system, such as a power distribution system. For example, this status signal may indicate that the breaker is untripped, that the breaker has been tripped due to overcurrent, that the breaker has been tripped due to a ground fault, etc.

Those having skill in the art will understand that other arrangements of signals may be supported by plug 180 without departing from the invention.

Figure 2:
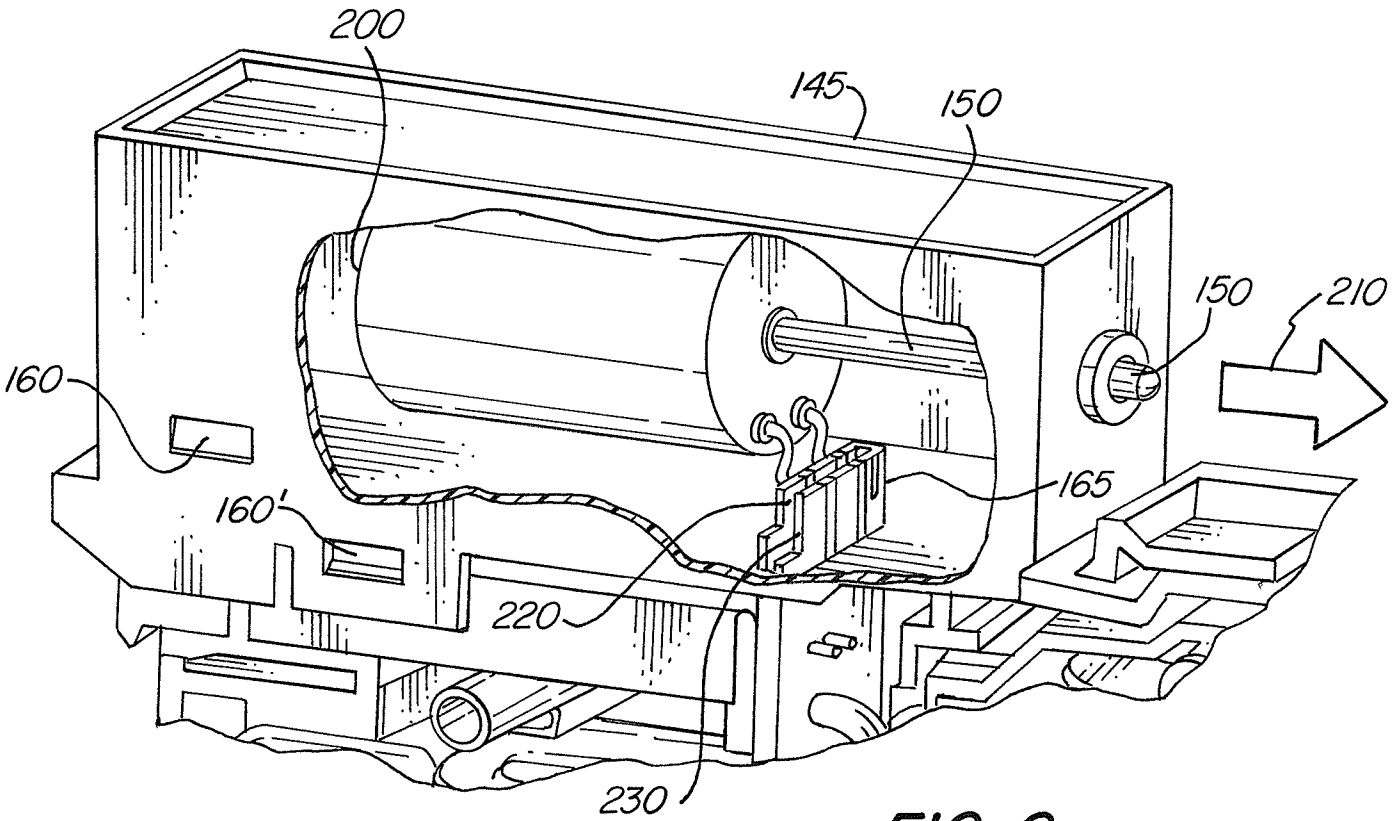
FIG. 2 is a partially cut away perspective view of the modular actuator module portion of the circuit breaker shown in FIG. 1.

FIG. 2 is a cutaway view of remote resetting module 145, illustrating aspects of the invention.

Module 145 includes a solenoid 200. Solenoid 200 is configured to extend piston 150 in the direction indicated by arrow 210 when solenoid 200 is energized. Piston 150 is shown configured as an armature of solenoid 200. However, those having skill in the art will understand that other types of electromechanical actuators may be used without departing from the invention.

Solenoid 200 is connected to breaker 100 via a plug connection 165. As shown, connector 165 may include a female edge connector 220 disposed within module 145, which is a counterpart to a male edge connector 230 disposed on PCB 199. When module 145 is connected to breaker 100 via tabs 160 and 160', male edge connector 230 is seated within female edge connector 240 such that a signal may be supplied to energize or de-energize solenoid 200. Those having skill in the art will understand that various other configurations of connection 165 are possible without departing from the invention, including other types of plugs.

Solenoid 200 may be activated using a remote signal, such as a signal supplied via PCB 199 from remote resetting terminals 185, 190.

Solenoid 200 may be configured such that piston 150 is biased to a retracted position (shown). In this case, piston 150 will revert to the retracted position unless solenoid 200 is energized. This can have the advantage of preventing switch handle 135 (FIG. 1) from being obstructed by piston 150 due to a power fault or other malfunction.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker comprising:

a housing;

a circuit breaker mechanism having a tripped state and an untripped state;

a switch handle having an off position and an on position and configured to toggle the circuit breaker between the tripped state and the untripped state;

a printed circuit board having a male edge connector; and an actuator disposed to move the switch handle from the off position to the on position, the actuator having a female edge connector;

wherein the actuator is a self-contained modular assembly adapted to be attached and removed from the housing as a unit;

wherein said circuit breaker is configured such that attaching the actuator to the housing simultaneously engages the female edge connector and male edge connector, electrically connecting the actuator to current running through the circuit breaker.

2. The circuit breaker of claim 1, wherein the actuator comprises a solenoid.

3. The circuit breaker of claim 1, wherein the actuator comprises a linear actuator.

4. The circuit breaker of claim 1, further comprising a wiring harness having a terminal in communication with the actuator.

5. The circuit breaker of claim 4, wherein the actuator is remotely operable by supplying a signal to the terminal.

6. The circuit breaker of claim 1, further comprising a voltage coil configured to selectively trip the circuit breaker mechanism.

7. The circuit breaker of claim 6, wherein the voltage coil is configured to trip the circuit breaker mechanism when there is a ground fault.

8. The circuit breaker of claim 6, wherein the voltage coil is configured to trip the circuit breaker mechanism when there is earth leakage.

9. The circuit breaker of claim 6, wherein the voltage coil is configured to trip the circuit breaker mechanism in response to a signal.

10. The circuit breaker of claim 6, wherein the voltage coil is connected to a wiring harness.

11. The circuit breaker of claim 10, wherein the voltage coil is configured to trip the circuit breaker mechanism in response to a signal received via the wiring harness.

12. The circuit breaker of claim 6, wherein the voltage coil is configured to remotely trip the circuit breaker mechanism.

13. The circuit breaker of claim 1 wherein the circuit breaker outputs a signal indicative of breaker status.

14. The circuit breaker of claim 13 wherein the output is produced by an auxiliary switch.

15. The circuit breaker of claim 13 wherein the breaker status comprises one of the following: breaker untripped, breaker tripped due to overcurrent, and breaker tripped due to ground fault.

16. The circuit breaker of claim 1 further comprising an interface adapted to communicate with a power distribution system.

17. A circuit breaker comprising:

a housing;

a circuit breaker mechanism having a tripped state and an untripped state;

a switch handle having an off position and an on position and configured to toggle the circuit breaker between the tripped state and the untripped state;

a voltage coil in electrical communication with a wiring harness and configured to trip the circuit breaker mechanism upon receiving a trip signal via the wiring harness;

an actuator disposed to move the switch handle from the off position to the on position;

wherein the actuator is a self-contained modular assembly adapted to be attached and removed from the housing as a unit using a tab-and-slot connection and which comprises a solenoid having a linearly actuating armature;

wherein the solenoid is in communication with the wiring harness via a printed circuit board and is actuated upon receiving a reset signal via the wiring harness;

wherein the solenoid is electrically connected to the printed circuit board via a male edge connection on the printed circuit board and a mating female edge connection on the actuator;

wherein attaching the actuator to the housing simultaneously connects the actuator electrically to the printed circuit board via the edge connection.

* * * * *